US009957948B2

(12) United States Patent
Tinwell et al.

(10) Patent No.: US 9,957,948 B2
(45) Date of Patent: May 1, 2018

(54) IGNITION UNIT AND SYSTEM

(71) Applicant: APOJEE, Clermont-Ferrand (FR)

(72) Inventors: Paul Tinwell, Clermont-Ferrand (FR); Andre Agneray, Clermont-Ferrand (FR)

(73) Assignee: APOJEE, Clermont-Ferrand (FR)

( * ) Notice: Subject to any disclaimer, the term of this patent is extended or adjusted under 35 U.S.C. 154(b) by 0 days. days.

(21) Appl. No.: 15/327,368

(22) PCT Filed: Jul. 21, 2015

(86) PCT No.: PCT/EP2015/066647
§ 371 (c)(1),
(2) Date: Jan. 18, 2017

(87) PCT Pub. No.: WO2016/012448
PCT Pub. Date: Jan. 28, 2016

(65) Prior Publication Data

US 2017/0152830 A1 Jun. 1, 2017

(30) Foreign Application Priority Data

Jul. 21, 2014 (EP) ..... 14306183

(51) Int. Cl.
*F02P 23/04* (2006.01)
*H01T 13/40* (2006.01)

(52) U.S. Cl.
CPC ..... *F02P 23/045* (2013.01); *H01T 13/40* (2013.01)

(58) Field of Classification Search
CPC .... F02P 3/01; F02P 9/007; F02P 23/04; F02P 23/045; H01T 13/20; H01T 13/40; H01T 13/42; H01T 13/50
(Continued)

(56) References Cited

U.S. PATENT DOCUMENTS

2010/0229639 A1* 9/2010 Agneray ..... F02P 17/12 73/114.67
2012/0180743 A1 7/2012 Burrows et al.
(Continued)

FOREIGN PATENT DOCUMENTS

DE 10037536 A1 2/2002
DE 102005037256 A1 2/2007
(Continued)

OTHER PUBLICATIONS

International Search Report dated Oct. 30, 2015, for International Patent Application No. PCT/EP2015/066647.
(Continued)

*Primary Examiner* — John Kwon
*Assistant Examiner* — Johnny H Hoang
(74) *Attorney, Agent, or Firm* — Karceski IP Law, PLLC

(57) ABSTRACT

An ignition unit produces an ignition in a combustion chamber of a combustion engine in the following manner. The ignition unit comprises a radiofrequency resonator that radiates a plasma-creating radiofrequency field into the combustion chamber. The ignition unit further comprises a microwave resonator that radiates a plasma-boosting microwave field into the combustion chamber. In an embodiment, the microwave resonator has an output surface to which the combustion chamber is exposed when the ignition unit is fitted on the combustion engine. The radiofrequency resonator may comprise an electrode that is at least partially embedded in the microwave resonator. The electrode may have a tip that is located at a distance from the output surface so that the microwave resonator provides a barrier between the tip and the output surface.

12 Claims, 4 Drawing Sheets

(58) Field of Classification Search
USPC ... 123/143 A, 143 B, 143 R, 169 E, 169 EL, 123/169 CA, 169 R
See application file for complete search history.

(56) References Cited

U.S. PATENT DOCUMENTS

| | | | |
|---|---|---|---|
| 2013/0155570 | A1 | 6/2013 | Stifel et al. |
| 2013/0293086 | A1 | 11/2013 | Pariente et al. |
| 2014/0137845 | A1 | 5/2014 | Achtstatter et al. |

FOREIGN PATENT DOCUMENTS

| | | | |
|---|---|---|---|
| EP | 2687714 | A2 | 1/2014 |
| EP | 2717398 | A1 | 4/2014 |
| JP | 2011150830 | A | 8/2011 |
| JP | 2014088778 | A | 5/2014 |
| WO | WO 2010129535 | A2 | 11/2010 |

OTHER PUBLICATIONS

International Preliminary Report on Patentability dated Oct. 14, 2016, for International Patent Application No. PCT/EP2015/066647.

* cited by examiner

IGNITION UNIT AND SYSTEM

CROSS-REFERENCE TO RELATED APPLICATION(S)

This is a National Stage Entry into the United States Patent and Trademark Office from International PCT Patent Application No. PCT/EP2015/066647, having an international filing date of Jul. 21, 2015, which claims priority to European Patent Application No. 14306183.6, filed Jul. 21, 2014, the entire contents of both of which are incorporated herein by reference.

FIELD OF THE INVENTION

An aspect of the invention relates to an ignition unit that can produce an ignition in a combustion chamber of a combustion engine. The ignition unit may have an external shape that is similar to a conventional sparkplug. The ignition unit may thus be fitted in a combustion engine as if this unit were a conventional sparkplug. The ignition unit may also be applied to, for example, turbine engines. Other aspects of the invention relate to an ignition system, a motorized product, and a method of producing an ignition in a combustion chamber.

BACKGROUND OF THE INVENTION

An electric spark discharge can produce an ignition in a combustion chamber of a combustion engine. The electric spark discharge across two spark plug electrodes creates a plasma within the combustion chamber. The plasma can ignite a fuel-air mixture that is present in the combustion chamber. This ignition technique is commonly referred to as spark ignition.

Spark ignition suffers from several drawbacks. First of all, there is relatively poor energy transfer efficiency. A relatively large proportion of electrical energy does not contribute to heating the plasma once this is formed. Moreover, the more electrical energy is used for spark ignition, the less efficient this energy is converted into heat. A further drawback is that the plasma that is formed is of relatively small volume, mainly located between two electrodes. The electrodes need to be relatively close to each other. If not, an excessively high voltage would be required for an electric spark discharge.

The drawbacks of spark ignition become particularly manifest in recently developed combustion concepts, which impose more difficult ignition conditions. Examples of such combustion concepts include those referred to as high dilution, high compression ratio, variable valve actuation, lean burn, gasoline direct injection in lean burn conditions, homogeneous charge compression ignition, and camless. The latter term refers to an engine without a camshaft, in which an electromagnetic or hydraulic actuator functionally replaces the camshaft. In one or more of these processes, ignition conditions may be difficult due to, for example, poor homogeneity of the fuel-air mixture, this mixture being highly diluted, and this mixture having a relatively high pressure when ignition should occur. By the way, the fuel-air mixture may contain a significant proportion of recirculated exhaust gas.

Spark ignition sets limits on achieving higher engine efficiency and lower emissions, which combustion processes such as those mentioned hereinbefore can provide. A main reason for this is that higher energy efficiency and lower emissions require an ignition with plasma that is relatively hot and voluminous. It is difficult, or even impossible, to create such plasma with spark ignition, in particular in a reliable and economical manner. For example, more electrical energy could be applied to a sparkplug to create hotter and more voluminous plasma. However, this would generally be at the expense of more erosion. The sparkplug would have a shorter lifetime.

SUMMARY OF THE INVENTION

There is a need for an ignition technique that allows higher combustion efficiency with satisfactory durability.

In order to better address this need, in accordance with an aspect of the invention, there is provided an ignition unit adapted to produce an ignition in a combustion chamber of a combustion engine, the ignition unit comprising:

- a radiofrequency resonator adapted to radiate a plasma-creating radiofrequency field into the combustion chamber; and
- a microwave resonator adapted to radiate a plasma-boosting microwave field into the combustion chamber Other aspects of the invention concern an ignition system comprising an ignition unit as defined hereinbefore, a motorized product, and a method of generating an ignition in a combustion chamber that comprises:

- an initial plasma creation step, in which a plasma-creating radiofrequency field is radiated into the combustion chamber so as to create an initial plasma; and
- a plasma-boosting step, in which a plasma-boosting microwave field is radiated into the combustion chamber so to expand and heat the initial plasma.

In each of these aspects, it is sufficient that the plasma-creating radiofrequency field creates initial plasma of relatively small volume and of relatively low energy. The plasma-boosting microwave field can expand and heat this initial plasma. The plasma-creating radiofrequency field does therefore not need to be relatively strong. The plasma-boosting microwave field does not need to be relatively strong either. A relatively strong microwave field would be required if this field had to create plasma. Moreover, this microwave field would have to be rapidly and significantly reduced in strength as soon as the plasma is created, in order to avoid reflections that could damage a microwave driver. In contrast, a microwave field of modest strength is sufficient to expand and heat already existing plasma. These relatively modest power requirements on both aforementioned fields avoid durability issues, in particular with regard to the radiofrequency resonator and the microwave driver. Relatively voluminous and hot plasma, which contributes to combustion efficiency, can be obtained without undue stress on components, thus allowing satisfactory durability.

An embodiment of the invention may comprise one or more additional features as defined in the paragraphs that follow.

The radiofrequency resonator may comprise an electrode that is at least partially embedded in the microwave resonator. The microwave resonator may comprise an output surface to which the combustion chamber is exposed when the ignition unit is fitted on the combustion engine.

The radiofrequency resonator may comprise a tip that is located at a distance from the output surface of the microwave resonator, so that a portion of the microwave resonator constitutes a barrier between the tip of the radiofrequency resonator and the combustion chamber.

The output surface of the microwave resonator may have a shape adapted to bundle the plasma-boosting microwave field that is radiated into the combustion chamber.

The output surface of the microwave resonator may comprise an annular groove.

The radiofrequency resonator may comprise a winding that couples a signal input connection to the electrode, which is at least partially embedded in the microwave resonator.

The ignition unit may comprise a cylindrical tube surrounding the winding. The cylindrical tube and the winding may then be adapted to form a microwave transmission path between the signal input connection and the microwave resonator.

The winding may have a central section having an outer diameter that is comprised in a range between 0.5 and 0.6 times an inner diameter of the cylindrical tube surrounding the winding.

The winding may have two tapered end sections.

At a tapered end section, the outer diameter of the winding may reduce to a value comprised in a range between 0.2 and 0.5 times the inner diameter of the cylindrical tube surrounding the winding.

A conductive cap may electrically couple the winding to the electrode of the radiofrequency resonator. The conductive cap may have a convex surface curving from the winding to the electrode.

The winding may be formed on a core element that is provided with a helical groove defining an inter-turn spacing.

The cylindrical tube may be filled with pressurized gas.

The input signal connection may form part of coaxial signal connector.

The microwave resonator may have a primary resonance frequency in a range between 1 and 10 GHz. The radiofrequency resonator may have a primary resonance frequency in a range between 1 and 10 MHz.

For the purpose of illustration, a detailed description of some embodiments of the invention is presented with reference to accompanying drawings.

DETAILED DESCRIPTION

Figure 1:
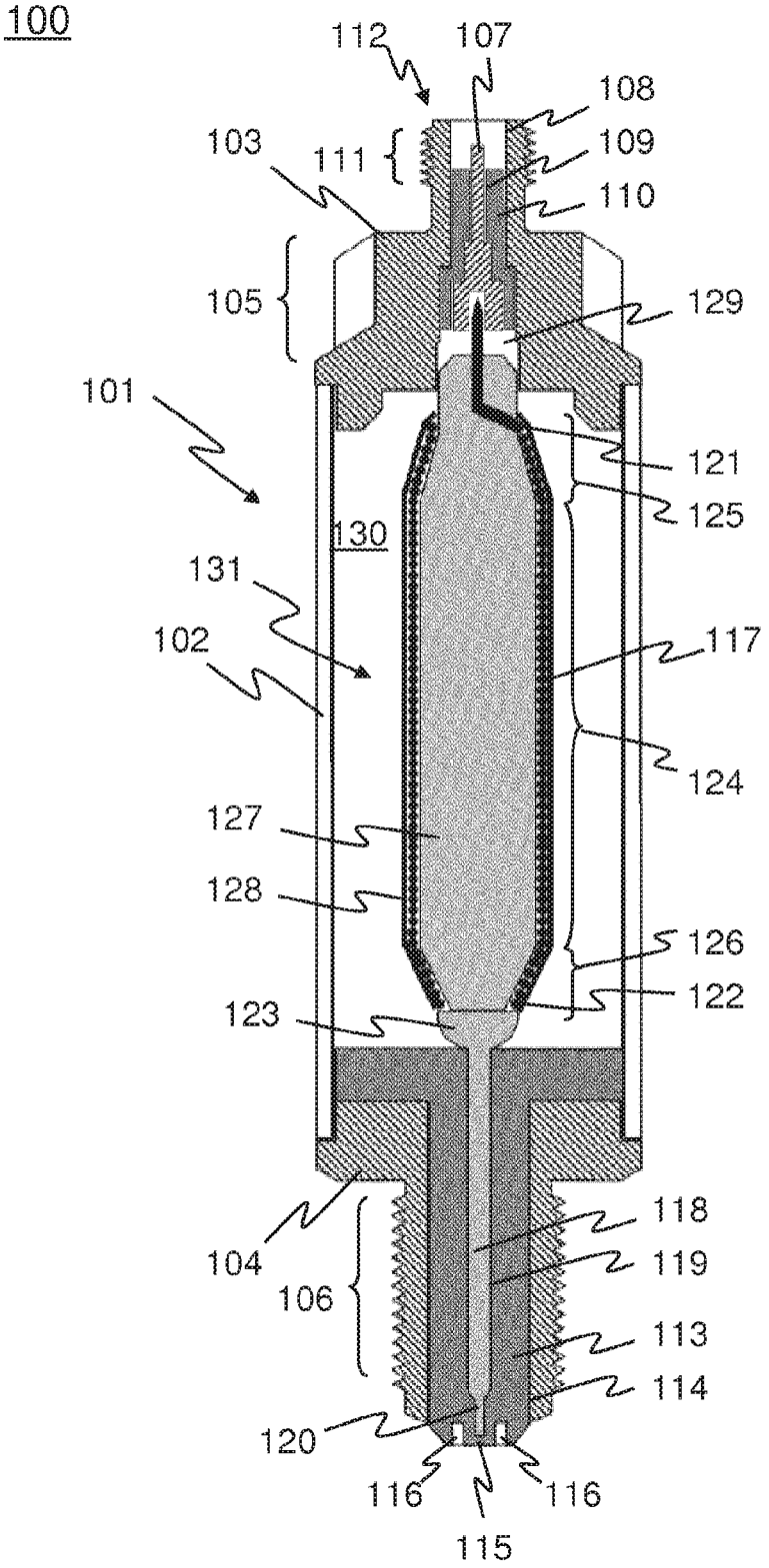
FIG. 1 schematically illustrates an ignition unit, which is represented in a cross-sectional diagram.

FIG. 1 schematically illustrates an ignition unit 100, which is represented in a cross-sectional diagram. The ignition unit 100 comprises a housing 101, which may at least partially be formed of conductive material, such as, for example, metal. The housing 101, or at least a part thereof, may electrically constitute signal ground.

The housing 101 comprises a cylindrical tube 102 and two end plugs, an input end plug 103 and an output end plug 104. The cylindrical tube 102 may be in the form of a steel tube that has an inner surface with silver (Ag) plating. The cylindrical tube 102 has an inner diameter, which may be comprised in a range between, for example, 15 mm and 21 mm. The two end plugs may also be formed of steel. The two end plugs may be fixed to the cylindrical tube 102 by means of, for example, laser welding.

The input end plug 103 comprises a section 105 with a hexagonal circumference. A wrench may engage with this section 105 for screwing the ignition unit 100 into a threaded opening in a combustion engine. The output end plug 104 comprises a section 106 with a cylindrical threaded circumference, which may engage with a threaded opening in a combustion engine. This section 106 of the output end plug 104 may have, for example, one of the following thread sizes, which are used for conventional sparkplugs: M12, M14, and M18. The ignition unit 100 may thus replace a conventional sparkplug.

The ignition unit 100 comprises a signal input connection 107 in a central bore 108 of the input end plug 103. More specifically, the signal input connection 107 is located in a central bore 109 of a cylindrical insulator 110. The cylindrical insulator 110 is located in the central bore 108 of the input end plug 103. The input end plug 103 has a cylindrical threaded section 111 that partially extends over the signal input connection 107. The cylindrical threaded section 111 and the signal input connection 107 may jointly form a signal connector 112 of, for example, of the N-type or the HN-type. Accordingly, the housing 101 of the ignition unit 100 may be coupled to signal ground. The ignition unit 100 may receive an input signal at the signal connector 112.

The ignition unit 100 comprises a microwave resonator 113 that is at least partially comprised in a central bore of 114 the output end plug 104. The central bore 114 has a diameter that will be discussed hereinafter. The microwave resonator 113 is preferably tightly fit in the central bore 114 so as to avoid air gaps between the microwave resonator 113 and the output end plug 104. The microwave resonator 113 may be of ceramic material, such as, for example, aluminium nitride, which has suitable properties for this application.

The microwave resonator 113 has a primary resonance frequency that may be comprised in a range between, for example, 1 GHz and 10 GHz. More specifically, the primary resonance frequency may be, for example, 2.45 GHz, which is a typical operating frequency of a microwave oven. The microwave resonator 113 may have an impedance at the primary resonance frequency that may be comprised in a range between, for example, 20Ω and 40Ω. The impedance is substantially determined by a relative permittivity of a material, or a set of materials, that form the microwave resonator 113. For example, the relative permittivity of plastic materials is approximately 2, whereas that of silicon nitride is approximately 10. In the middle of this range, the relative permittivities of boron nitride and aluminium nitride are approximately comprised between 4.3 and 4.5.

The microwave resonator 113 may have a length that can be expressed as $(2N+1)/4\lambda$, wherein $\lambda$ represents a wavelength corresponding with the primary resonance frequency of the microwave resonator 113, and wherein N represents an integer. The length of the microwave resonator 113 may thus be, for example, $3/4\lambda$.

In more detail, the microwave resonator 113 has an output surface 115, which may delimit a section protruding outwardly from the central bore 114 of the output end plug 104. A combustion chamber of a combustion engine may be exposed to this output surface 115 when the ignition unit 100 is fitted on the combustion engine. The output surface 115 has a specific shape that causes the output surface 115 to behave like a microwave lens. Thanks to this feature, the output surface 115 can bundle a microwave field that is radiated from the microwave resonator 113. In this example, the output surface 115 has an annular groove 116, which provides such a microwave field bundling effect.

Figure 2:
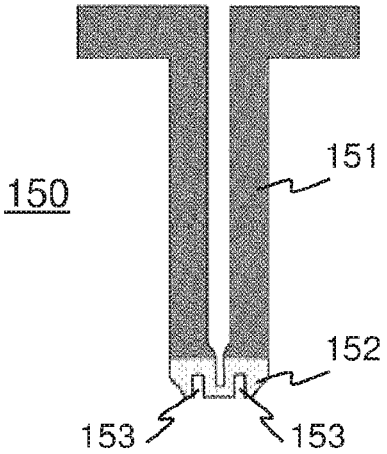
FIG. 2 schematically illustrates a composite microwave resonator, which is represented in a cross-sectional diagram.

FIG. 2 illustrates an example of a composite microwave resonator 150 formed of different dielectric materials. The composite microwave resonator 150 may replace the microwave resonator 113 illustrated in FIG. 1, which may be of monolithic structure and made up of a single dielectric material. The composite microwave resonator 150 illustrated in FIG. 2 comprises a main portion 151 and a cap portion 152, which may be made of different dielectric materials. This variant may provide additional degrees of freedom for optimizing performance. The cap portion 152 comprises an annular groove 153, similar to the annular groove 116 of the microwave resonator 113 illustrated in FIG. 1.

Referring again to FIG. 1, the ignition unit 100 further comprises a radiofrequency resonator, which is basically formed by a winding 117, an electrode 118, and a capacitive coupling between the winding 117 and the electrode 118 with the housing 101. The winding 117 may be formed of a wire of conductive material, such as, for example, copper. The wire has a diameter that will be discussed hereinafter. The wire may be bare, that is, without any coating. The electrode 118 may also be formed of conductive material, such as, for example, an Inconel™ type alloy, Inconel being a trademark of Special Metals Corporation. Inconel 600 could be an appropriate choice. As another example, nickel could also be an appropriate choice. The electrode 118 has a main section with a diameter that may be comprised in a range between, for example, 1.5 and 3.5 mm. There may be a ratio of approximately 1 to 2.7 between the diameter of the electrode 118 and the central bore 114 of the output end plug 104. The electrode 118 may have a tip section of smaller diameter, as illustrated in FIG. 1.

The winding 117 is located within the cylindrical tube 102 of the housing 101 as schematically illustrated in FIG. 1. That is, the cylindrical tube 102 surrounds the winding 117. The electrode 118 is located in a central bore 119 of the microwave resonator 113. That is, the electrode 118 is at least partially embedded in the microwave resonator 113. The microwave resonator 113 thus forms part of the capacitive coupling between the electrode 118 and the housing 101.

The radiofrequency resonator has a primary resonance frequency that may be comprised in a range between, for example, 1 Megahertz (MHz) and 10 MHz. More specifically, the primary resonance frequency may be, for example, 4 MHz. In that case, the winding 117 may have an inductance of, for example, 56 Microhenry (μH). The capacitive coupling may have a capacitance of, for example, 28 Picofarad (pF). The radiofrequency resonator may have an impedance at the primary resonance frequency that may be comprised in a range between, for example, 2 kΩ and 3.5 kΩ.

In more detail, the electrode 118 has a tip 120 that is located at a distance from the output surface 115. This distance may be in the order of, for example, a few millimeters. The microwave resonator 113, in which the electrode 118 is at least partially embedded, thus forms a barrier between the tip 120 and the output surface 115. This barrier protects the electrode 118 against wear, in general, and against corrosion in particular.

It should be noted that, in operation, the output surface 115 will at least partially be exposed to a highly oxidative environment within a combustion chamber. Thus, for example, if the tip 120 were to protrude from the output surface 115, the tip 120 would be exposed to this highly oxidative environment and, as a result, undergo corrosion. The aforementioned barrier, which may be relatively thin, prevents this and thus contributes to durability of the ignition unit 100.

The winding 117 has an input end 121 that is electrically coupled to the signal input connection 107 located in the input end plug 103. The winding 117 has an output end 122 that is electrically coupled to a conductive cap 123. The conductive cap 123 electrically couples the winding 117 to the electrode 118, which is embedded in the microwave resonator 113. The conductive cap 123 has a convex surface curving from the winding 117 to the electrode 118, as illustrated in FIG. 1. The conductive cap 123 may have, for example, a hemispherical shape. The conductive cap 123 helps to prevent internal flashover that could occur at the output end 122 of the winding 117. This will be explained in greater detail hereinafter.

The winding 117 has a central section 124 that has a substantially constant outer diameter. This outer diameter may be comprised in a range between, for example, 4.2 mm and 5.9 mm. More specifically, the outer diameter may be comprised in a range between, for example, 0.5 and 0.6 times the inner diameter of the cylindrical tube 102 surrounding the winding 117. That is, a ratio between the outer diameter of the central section 124 of the winding 117 and the inner diameter of the cylindrical tube 102 may be comprised in a range between, for example, 0.5 and 0.6. An optimal value may be 0.56 in the sense that this ratio provides a highest quality (Q) factor.

The winding 117 has two tapered end sections 125, 126. One tapered end section 125 extends from the central section 124 to the input end 121 of the winding 117. Another tapered end section 126 extends from the central section 124 to the output end 122 of the winding 117. At the one and the other tapered end section 125, 126, the outer diameter of the winding 117 reduces to a value comprised in a range between 0.2 and 0.5 times the inner diameter of the cylindrical tube 102 surrounding the winding 117. For example, the ratio may reduce to 0.368 at the input end 121 and at the output end 122. The tapered end section 126 at the output end of the winding 117 helps to prevent internal flashover that could occur at the output end 122 of the winding 117. This will be explained in greater detail hereinafter. The tapered end section 125 at the input end 121 of the winding 117 contributes to achieving proper impedance at the primary resonance frequency of the microwave resonator 113.

The winding 117 may have a length that can be expressed as $(2N+1)/2\lambda$, wherein $\lambda$ represents the wavelength corresponding with the primary resonance frequency of the microwave resonator 113, and wherein N represents an integer. The length of the winding 117 may thus be, for example, $3/2\lambda$. The length of the winding 117 is constrained by geometry considerations for the ignition unit 100. Namely, the ignition unit 100 should be compatible with, for example, typical automotive engines and typical aeronautic gas turbine engines. For example, a constraint may be that the ignition unit 100 should have a maximum length of 150 mm.

The winding 117 is formed on a core element 127, which may be in the form of a bobbin of dielectric material. The core element 127 is provided with a helical groove, which defines an inter-turn spacing. The inter-turn spacing defines an inter-turn capacitance, which also depends on the other parameters, such as, for example, the outer diameter of the winding 117, the diameter of the wire that forms the winding 117, and a dielectric constant of a medium between turns of the winding 117. The inter-turn capacitance is a critical parameter, which will be discussed hereinafter. The inter-turn capacitance is approximately 200 pF, which can be a suitable value, with the following combination of parameters: the helical groove defines a winding 117 pitch of 300 μmm, the diameter of the wire is 280 μmm, and the outer diameter of the winding 117 is approximately 10 mm.

A dielectric coating 128 may cover the winding 117 as illustrated in FIG. 1. In a manufacturing process, the dielectric coating 128 may be applied once the winding 117 has been formed on the core element 127. The dielectric coating 128 may be applied so that the aforementioned inter-turn capacitance is not significantly affected thereby. The dielectric coating 128 contributes to countering internal flashover in a cost-efficient manner.

Figure 3:
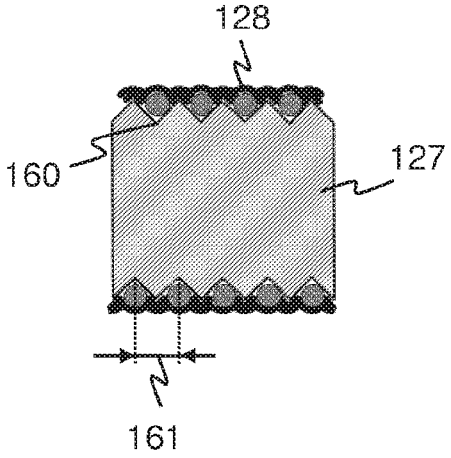
FIG. 3 schematically illustrates in greater detail an inner portion of the ignition unit, which is represented in a cross-sectional diagram.

FIG. 3 schematically illustrates in greater detail a portion of the winding 117 on the core element 127, which is represented in a cross-sectional diagram. Reference numeral 160 denotes the helical groove of the core element 127, which is represented in this figure. Reference numeral 161 denotes the inter-turn spacing. The dielectric coating 128 is also represented in this figure, as in FIG. 1.

Referring again to FIG. 1, the core element 127 may abut against the conductive cap 123 or against a dielectric coating 128 that is applied thereto, such as, for example, a conformal silicon rubber or a similar substance. An air gap 129 is left between, on the one hand, the core element 127 and, on the other hand, the signal input connection 107 and the cylindrical insulator 110 in which the signal input connection 107 is fitted. The air gap 129 accommodates for axial dilatation of components.

The cylindrical tube 102 may be filled with pressurized gas 130. This pressurized gas 130 constitutes a dielectric medium, which will be discussed hereinafter. The pressurized gas 130 may be, for example, pressurized air or pressurized nitrogen ($N_2$). The pressurized gas 130 may have a pressure of, for example, 20 bar. In case the aforementioned dielectric coating 128 on the winding 117 is absent, a higher pressure may be required to prevent internal flashover, or a more expensive gas, such as, for example, sulfur hexafluoride ($SF_6$) may also be required.

The cylindrical tube 102 and the winding 117 jointly form a microwave transmission path 131 between the signal input connection 107 and the microwave resonator 113. The pressurized gas 130 within cylindrical tube 102 forms a dielectric medium in this microwave transmission path 131. The microwave transmission path 131 within the ignition unit 100 may have an impedance of approximately 25Ω. This impedance value can be obtained with parameter values as presented hereinbefore.

Thus, the winding 117 plays two roles. Firstly, the winding 117 acts as a high-quality resonator at radio frequencies, which allows efficient creation of plasma within a combustion chamber. Secondly, the winding 117 allows a loss free transmission of incoming microwave energy to the microwave resonator 113, which contributes to efficiently maintaining the plasma. This is an original design aspect, which allows compactness and efficiency.

Efficiency can be optimized by a suitable choice of values for the following parameters: the inter-turn capacitance of the winding 117, the length of the winding 117, and the ratio between the outer diameter of the winding 117 and the inner diameter of the cylindrical tube 102. The microwave transmission path 131 is relatively loss free when the inter-turn capacitance is approximately 200 pF. As mentioned hereinbefore, the length of the winding 117 is constrained by geometry considerations for the ignition unit 100. This and other constraints make that a value in the range between 0.5 and 0.6 can be a suitable choice for the ratio between the outer diameter of the winding 117 and the inner diameter of the cylindrical tube 102. Such a value can also be a suitable choice for a ratio between the diameter of the electrode 118 and the diameter of the central bore 114 in the output end plug 104, in which the microwave resonator 113 and the electrode 118 are located.

In operation, the ignition unit 100 may receive a composite drive signal at the signal input connection 107. The composite drive signal may comprise a radiofrequency drive signal and a microwave drive signal. The radiofrequency drive signal will traverse the radiofrequency resonator described hereinbefore. This imposes a standing wave with a high voltage on a node coincident with the conductive cap 123. The electrode 118, which is also at this high voltage, will radiate a radiofrequency field into a space adjacent to the output surface 115, exterior from the ignition unit 100. This radiofrequency field can be sufficiently strong to create a plasma discharge in the aforementioned space. The tip section of the electrode 118, which is of smaller diameter, may provide a radiofrequency field amplification effect.

However, the aforementioned high voltage entails risks. The high voltage induces an electric field inside the microwave resonator 113 that may be sufficiently strong to cause dielectric breakdown. Moreover, there is a risk of internal flashover as mentioned hereinbefore. The tapered section 126 at the output end 122 of the winding 117 helps to reduce these risks.

The microwave transmission path 131 within the ignition unit 100, which is formed by the cylindrical tube 102 and the winding 117 located therein, transfers the microwave drive signal to the microwave resonator 113. An electric field standing wave is formed within the microwave resonator 113, such that a node of maximum voltage is coincident with the output surface 115. In response, the microwave resonator 113 radiates a microwave field from its output surface 115 into the space adjacent thereto. As mentioned here before, the annular groove 116 provides a microwave field bundling effect. The annular groove 116 acts, in effect, as a microwave field amplifier in a particular direction. That is, the microwave field can be directional.

Figure 4:
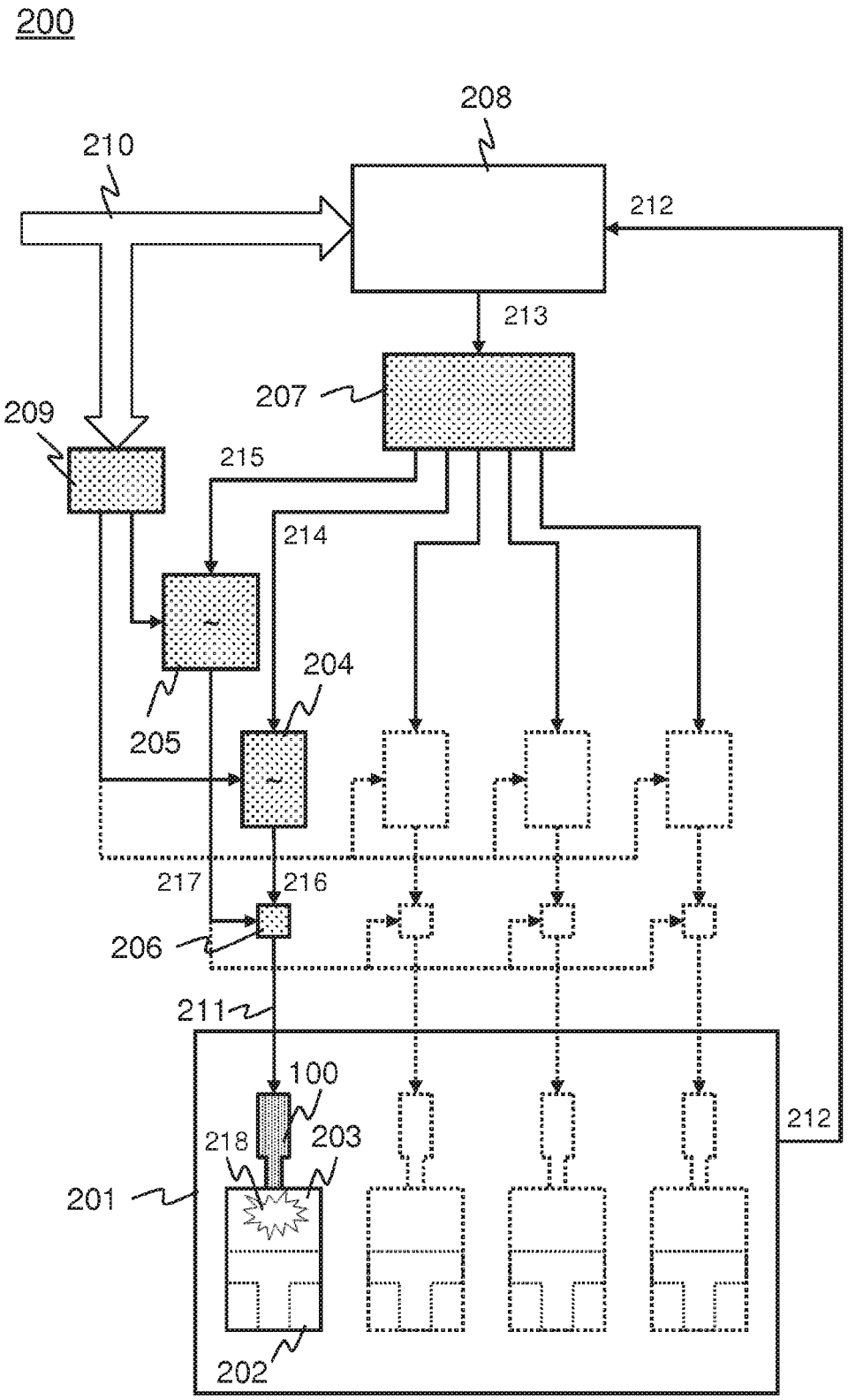
FIG. 4 schematically illustrates an ignition system, which is represented in a block diagram.

FIG. 4 schematically illustrates an ignition system 200 that is applied to an internal combustion engine 201. The internal combustion engine 201 will be referred to as engine 201 hereinafter for reasons of convenience. The engine 201 may form part of a motorized product, such as, for example, a vehicle. The ignition unit 100 described hereinbefore is mounted in the engine 201 as schematically illustrated in FIG. 4.

More specifically, the ignition unit 100 is mounted in a cylinder 202 of the engine 201, which has a combustion chamber 203. The combustion chamber 203 is exposed to the output surface 115 of the microwave resonator 113 illustrated in FIG. 1. The engine 201 may be provided with a fuel injection arrangement that can inject fuel into the combustion chamber 203. The engine 201 may further be provided with an air supply arrangement that can supply air to the combustion chamber 203. Such arrangements are not represented in FIG. 4 for reasons of simplicity and convenience.

The ignition system 200 comprises, in addition to the ignition unit 100, various other functional entities. These include a radiofrequency signal generator 204, a microwave signal generator 205, a signal combiner 206, an ignition unit controller 207, an engine control unit 208, a high-voltage power supply 209, and a direct current (DC) power bus 210.

Functional entities that are specific to the ignition unit 100 are represented with a dotted fill pattern. The microwave signal generator 205 may be in the form of, for example, a magnetron or a solid state microwave signal generator. The engine control unit 208 and the DC power bus 210 may be similar to equivalent functional entities that are used in a conventional ignition system, which typically comprises sparkplugs. These are therefore represented without a dotted fill pattern.

A signal transmission line 211 couples the signal connector 112 of the ignition unit 100 to the signal combiner 206. The signal transmission line 211 may be in the form of, for example, a flexible or semi-flexible co-axial cable. The engine control unit 208 and the high-voltage power supply 209 may be coupled to a direct current (DC) power bus 210.

The engine 201 may comprise one or more further cylinders as schematically illustrated in FIG. 4. Such a further cylinder may also be provided with an ignition unit 100 similar to the one illustrated in FIG. 1 and described hereinbefore. The ignition system 200 may then comprise one or more further radiofrequency signal generators and one or more further signal combiners, one radiofrequency signal generator and one signal combiner for each ignition unit. An ignition unit may thus uniquely be coupled to a particular radiofrequency signal generator via a signal combiner as schematically illustrated in FIG. 4. However, all ignition units may collectively be coupled to the microwave signal generator 205 via respective signal combiners as schematically illustrated in FIG. 4. This will be explained in greater detail hereinafter.

Figure 5:
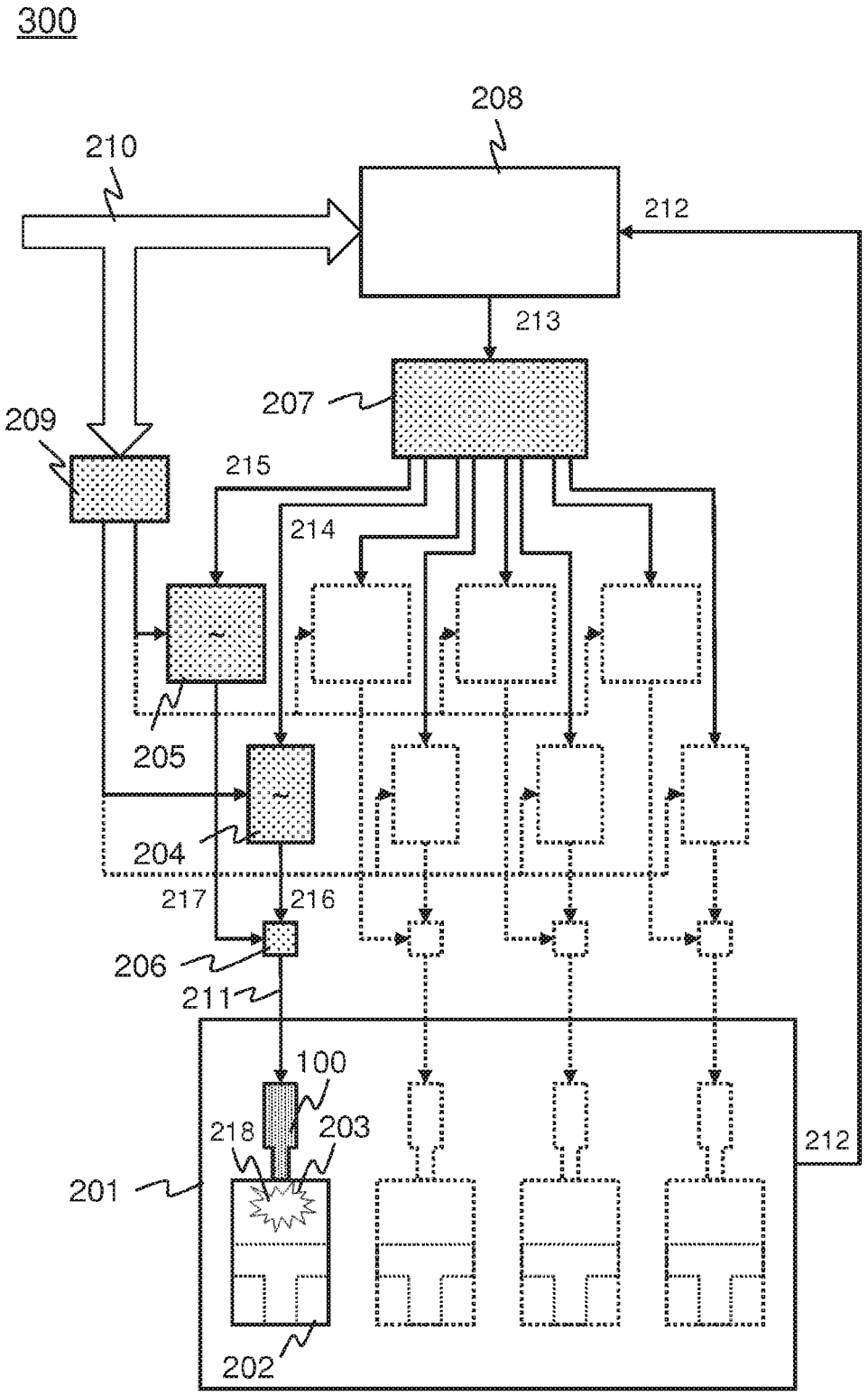
FIG. 5 schematically illustrates an alternative ignition system, which is represented in a block diagram.

FIG. 5 schematically illustrates an alternative ignition system 300 that is applied to the engine 201. Like elements are denoted by like reference numerals. The alternative ignition system 300 differs from the ignition system 200 illustrated in FIG. 4 primarily in that the alternative ignition system 300 comprises one or more further microwave signal generators, one for each ignition unit. In the alternative ignition system 300, an ignition unit may thus also uniquely be coupled to a particular microwave signal generator via a signal combiner as schematically illustrated in FIG. 5.

The ignition system 200 and the alternative ignition system 300 basically operate as follows. The engine control unit 208 receives operational state information 212 from the engine 201. The operational state information 212 provides information on a combustion process that takes place with the cylinder 202. For example, the operational state information 212 may indicate a current state within a combustion cycle that takes place in the cylinder 202. The engine control unit 208 provides an ignition control signal 213 in response to this operational state information 212. The ignition control signal 213 indicates to the ignition unit controller 207 when an ignition should start in the cylinder 202 given the information on the combustion process that the engine has communicated to the engine control unit 208. The ignition unit controller 207 generates a radiofrequency power control signal 214 and a microwave power control signal 215 on the basis of the ignition control signal 213.

Figure 6:
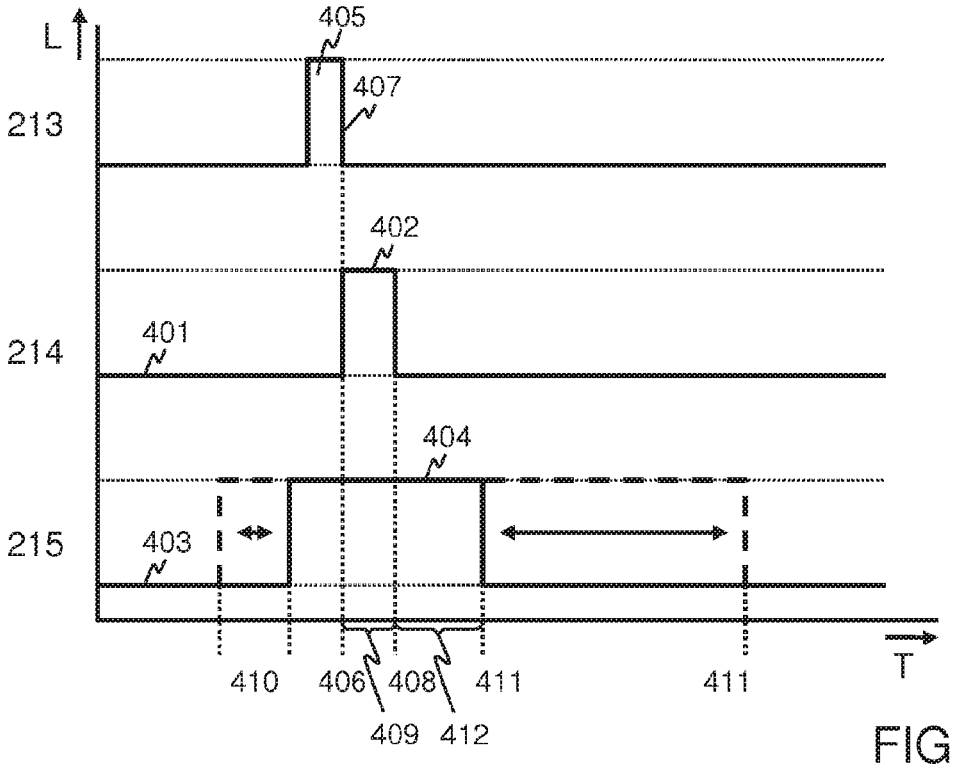
FIG. 6 schematically illustrates various control signals for the ignition unit, which are represented in a time diagram.

FIG. 6 schematically illustrates various control signals that can occur in the ignition system 200, as well as in the alternative ignition system 300. These control signals are schematically represented in a time diagram. The time diagram has a horizontal axis that represents time T, and a vertical axis that represents signal level L, or power level, whichever applies. The time diagram is divided into respective horizontal sections representing respective control signals. An upper section represents the ignition control signal 213 mentioned hereinbefore. A middle section represents the radiofrequency power control signal 214 mentioned hereinbefore. A lower section the microwave power control signal 215 mentioned hereinbefore. Further details of operation of the ignition system 200 illustrated in FIG. 4 and the alternative ignition system 300 illustrated in FIG. 5 can be elucidated with reference to the control signals illustrated in FIG. 6.

The radiofrequency power control signal 214 can be at a level comprised in a range between a zero level 401 and a maximum level 402. The radiofrequency signal generator 204 is, in effect, switched off when the radiofrequency power control signal 214 is at the zero level 401. The radiofrequency signal generator 204 applies, via the signal combiner 206, a radiofrequency power signal 216 to the ignition unit 100 when the radiofrequency power control signal 214 is at the maximum level 402. It should be noted that the radiofrequency power control signal 214 may be binary in the sense that the zero level 401 and the maximum level 402 are the only two possible levels.

Similarly, the microwave power control signal 215 can be at a level comprised in a range between a zero level 403 and a maximum level 404. The microwave signal generator 205 is, in effect, switched off when the microwave power control signal 215 is at the zero level 403. The microwave signal generator 205 applies, via the signal combiner 206, a microwave power signal 217 to the ignition unit 100 when the microwave power control signal 215 is at the maximum level 404. The microwave power control signal 215 may also be binary in the sense that the zero level 403 and the maximum level 404 are the only two possible levels.

However, in the ignition system 200 illustrated in FIG. 4, the ignition unit controller 207 need not provide a microwave power control signal, such as the microwave power control signal 215 illustrated in FIG. 6. The microwave signal generator 205 may continuously provide a microwave power signal 217 of constant power. In this case, a magnetron is particularly suited to form the microwave signal generator 205. Otherwise, a solid-state microwave signal generator may be preferred because this type of generator provides a sufficiently fast transient response, allowing for a relatively rapid switching between different power levels.

FIG. 6 illustrates that the ignition control signal 213 comprises a trigger pulse 405 that indicates when an ignition should start in the cylinder 202. Upon reception of this trigger pulse 405, the ignition unit controller 207 switches the radiofrequency power control signal 214 from the zero level 401 to the maximum level 402 at an instant 406. This instant 406 may closely coincide with a negative edge 407 of the trigger pulse 405, which marks the end of this pulse. From this instant 406, the radiofrequency signal generator 204 applies, via the signal combiner 206, the radiofrequency power signal 216 to the ignition unit 100. This causes the ignition unit 100 to radiate a radiofrequency field into the combustion chamber 203, in a manner as described hereinbefore with reference to FIG. 1. The radiofrequency field creates plasma in the combustion chamber 203. The instant 406 illustrated in FIG. 6 will therefore be referred to as plasma creation start 406 hereinafter.

The ignition unit controller 207 maintains the radiofrequency power control signal 214 at the maximum level 402 for a relatively short duration. The radiofrequency power control signal 214 returns to the zero level 401 at an instant 408 illustrated in FIG. 6. At this instant 408, the radiofrequency power signal 216 is, in effect, switched off. The radiofrequency field in the combustion chamber 203 is, in effect, extinguished. The instant 408 illustrated in FIG. 6 will be referred to as plasma creation end 408 hereinafter.

The plasma creation start 406 and the plasma creation end 408 delimit a plasma creation time interval 409 during which the ignition unit 100 radiates a plasma-creating radiofrequency field into the combustion chamber 203. The plasma creation time interval 409 may be relatively short as schematically illustrated in FIG. 6.

FIG. 6 further illustrates that the microwave power control signal 215 is at the maximum level 404 during the plasma creation time interval 409. The microwave power control signal 215 continues to be at this level after this time interval for at least a given duration as schematically illustrated in FIG. 6. The microwave signal generator 205 thus applies, via the signal combiner 206, the microwave power signal 217 to the ignition unit 100 during the plasma creation time interval 409 and, more importantly, continues to do so after this time interval. This causes the ignition unit 100 to radiate a microwave field into the combustion chamber 203, in a manner as described hereinbefore with reference to FIG. 1.

Following the plasma creation time interval 409, the microwave field sustains and even boosts the plasma that has been created by the radiofrequency field. The microwave field may substantially heat and expand the plasma in volume. This heated and expanded plasma produces an ignition 218 in the combustion chamber 203. This ignition 218 causes combustion of fuel and air that has been injected and inducted, respectively, into the combustion chamber 203.

The microwave power signal 217 may have a relatively modest power level. This is sufficient to substantially heat and expand the plasma in volume. For example, the microwave power signal 217 may have a power level of 400 Watt (W), or may have an even lower power level. An appropriate power level may empirically be determined. This power level may vary depending on, for example, a type of combustion engine to which the ignition system 200 is applied, a type of fuel that is used, as well as other parameters relating to the engine 201 and its operating conditions. Similarly, the primary resonance frequency of the microwave resonator 113 may empirically be determined.

Furthermore, the microwave power signal 217 does not need to be timed precisely. FIG. 6 illustrates this by means of dashed lines in the microwave power control signal 215. The microwave power signal 217 may even be continuous as mentioned hereinbefore. However, the plasma that the radiofrequency field creates and that the microwave field sustains and even boosts, should preferably extinguish before an intake-stroke of a subsequent combustion cycle. This may require a reduction in power of the microwave power signal 217, or may even require a switching off of this signal, after the combustion has started. In that case, the microwave signal generator 205 should have a relatively fast transient response, which a solid-state microwave signal generator can provide.

FIG. 6 illustrates an exemplary case in which the microwave power signal 217 is switched on and off. The ignition unit controller 207 switches the microwave power control signal 215 from the zero level 403 to a maximum level 404 at an instant 410. This microwave start instant 410 may precede the plasma creation start 406 as illustrated in FIG. 6. The ignition unit controller 207 switches the microwave power control signal 215 back to the zero level 403 at an instant 411. This microwave end instant 411 occurs after the plasma creation end 408. The microwave end instant 411 defines a plasma-boosting time interval 412 during which the plasma, which the radiofrequency field has created, is boosted. An appropriate timing of the microwave power signal 217, and thus of the aforementioned instants 410, 411, may empirically be determined. This timing may vary depending on, for example, a type of combustion engine to which the ignition system 200 is applied, a type of fuel that is used, as well as other parameters relating to the engine 201 and its operating conditions.

In summary, in the embodiments described hereinbefore, initial plasma is generated by the radiofrequency field. The microwave field is relieved of this task. The microwave field primarily has a task of heating and expanding the initial plasma that the radiofrequency field has generated. In order to fulfill this task, the microwave field need not be relatively strong, and need not be precisely timed. In some embodiments, the microwave field may even be continuous. Precise ignition timing can be achieved through the radiofrequency field. The radiofrequency field need not be relatively strong either. The initial plasma can be relatively small and modestly hot; the microwave field will expand and heat the initial plasma. Thus some loss can be tolerated in generating the radiofrequency field. The radiofrequency resonator may thus be protected by a dielectric barrier that may introduce some loss, but may significantly contribute to durability.

Notes

The detailed description hereinbefore with reference to the drawings is merely an illustration of the invention and the additional features, which are defined in the claims. The invention can be implemented in numerous different ways. In order to illustrate this, some alternatives are briefly indicated.

The invention may be applied in numerous types of products or methods related to producing an ignition in a combustion chamber. For example, the invention may be applied in any type of positively ignited engine. Such an engine may be, for example, a racing engine, an automotive engine for a car, a motorcycle, a truck, and so on, a large transport engine for railway transportation, a stationary engine used for, for example, electrical power generation, or a continuous combustion engine, in particular gas and liquid-fuelled turbines for aircraft or other use.

In general, there are numerous different ways of implementing the invention, whereby different implementations may have different topologies. In any given topology, a single module may carry out several functions, or several modules may jointly carry out a single function. In this respect, the drawings are very diagrammatic. For example, the high-voltage power supply 209 illustrated in FIGS. 4 and 5 may comprise ignition coils that are used in conventional sparkplug ignition systems.

In an alternative embodiment, a radiofrequency resonator may comprise a coreless winding. In that case, the winding may enclose a filling within a cylindrical tube that encapsulates the winding. This filling may be air or a substance, which may be a gaseous, liquid, or solid. The filling substance may have dielectric properties such as, for example, SF6 gas, transformer oil, or epoxy resin.

In yet another alternative embodiment, an inner volume of the winding may constitute a microwave transmission path. Such an alternative embodiment may comprise a dielectric coupler arranged between a microwave signal connector and the winding.

The remarks made hereinbefore demonstrate that the detailed description with reference to the drawings is an illustration of the invention rather than a limitation. The invention can be implemented in numerous alternative ways that are within the scope of the appended claims. All changes that come within the meaning and range of equivalency of the claims are to be embraced within their scope. Any reference sign in a claim should not be construed as limiting the claim. The word "comprising" does not exclude the presence of other elements or steps than those listed in a claim. The word "a" or "an" preceding an element or step does not exclude the presence of a plurality of such elements or steps. The mere fact that respective dependent claims define respective additional features, does not exclude combinations of additional features other than those reflected in the claims.

The invention claimed is:

1. An ignition unit adapted to produce an ignition in a combustion chamber of a combustion engine, the ignition unit comprising:

a signal input connection;

a radiofrequency resonator adapted to radiate a plasma-creating radiofrequency field into the combustion chamber; and a microwave resonator adapted to radiate a plasma-boosting microwave field into the combustion chamber, the microwave resonator comprising an output surface to which the combustion chamber is exposed when the ignition unit is fitted on the combustion engine, wherein the radiofrequency resonator comprises:

an electrode that is at least partially embedded in the microwave resonator; and a winding that couples the signal input connection to the electrode, the winding being surrounded by a cylindrical tube, the winding being adapted to form a microwave transmission path between the signal input connection and the microwave resonator, the microwave transmission path being formed by one of the two following volumes: an outer volume between the winding and the cylindrical tube, and an inner volume of the winding.

2. An ignition unit according to claim 1, wherein the radiofrequency resonator comprises a tip that is located at a distance from the output surface of the microwave resonator, so that a portion of the microwave resonator constitutes a barrier between the tip of the radiofrequency resonator and the combustion chamber.

3. An ignition unit according to claim 1, wherein the output surface of the microwave resonator has a shape adapted to bundle the plasma-boosting microwave field that is radiated into the combustion chamber.

4. An ignition unit according to claim 3, wherein the output surface of the microwave resonator comprises an annular groove.

5. An ignition unit according to claim 1, wherein the winding has a central section, having an outer diameter that is comprised in a range between 0.5 and 0.6 times an inner diameter of the cylindrical tube surrounding the winding.

6. An ignition unit according to claim 1, wherein the winding has two tapered end sections at which the outer diameter of the winding reduces to a value comprised in a range between 0.2 and 0.5 times the inner diameter of the cylindrical tube surrounding the winding.

7. An ignition unit according to claim 1, comprising a conductive cap that electrically couples the winding to the electrode of the radiofrequency resonator, the conductive cap having a convex surface curving from the winding to the electrode.

8. An ignition unit according to claim 1, wherein the winding is formed on a core element that is provided with a helical groove defining an inter-turn spacing.

9. An ignition unit according to claim 1, wherein the cylindrical tube is filled with pressurized gas.

10. An ignition unit according to claim 1, wherein the microwave resonator has a primary resonance frequency in a range between 1 and 10 GHz, and the radiofrequency resonator has a primary resonance frequency in a range between 1 and 10 MHz.

11. An ignition system comprising at least one ignition unit according to claim 1.

12. A motorized product comprising a combustion engine and an ignition system according to claim 11.

* * * * *